US006712030B2

(12) United States Patent
Chiappini et al.

(10) Patent No.: US 6,712,030 B2
(45) Date of Patent: Mar. 30, 2004

(54) INTERNAL-COMBUSTION ENGINE WITH HYDRAULIC SYSTEM FOR VARIABLE OPERATION OF THE ENGINE VALVES

(75) Inventors: Stefano Chiappini, Orbassano (IT); Andrea Pecori, Orbassano (IT); Francesco Vattaneo, Pancalieri (IT)

(73) Assignee: C.R.F. Societa Consortile per Azioni, Orbassano (IT)

( * ) Notice: Subject to any disclaimer, the term of this patent is extended or adjusted under 35 U.S.C. 154(b) by 0 days.

(21) Appl. No.: 10/102,922

(22) Filed: Mar. 22, 2002

(65) Prior Publication Data

US 2002/0134331 A1 Sep. 26, 2002

(30) Foreign Application Priority Data

Mar. 23, 2001 (IT) ..... TO2001A000271

(51) Int. Cl.[7] ..... F01L 9/02; F01L 13/00

(52) U.S. Cl. ..... 123/90.12; 123/90.16; 123/90.57

(58) Field of Search ..... 123/90.12, 90.13, 123/90.15, 90.16, 90.48, 90.49, 90.55, 90.57, 198 F

(56) References Cited

U.S. PATENT DOCUMENTS

| | | | | |
|---|---|---|---|---|
| 4,466,390 A | | 8/1984 | Babitzka et al. | |
| 4,671,221 A | | 6/1987 | Geringer et al. | |
| 4,765,288 A | | 8/1988 | Linder et al. | |
| 4,889,084 A | | 12/1989 | Rembold | |
| 4,889,085 A | * | 12/1989 | Yagi et al. | 123/90.12 |
| 5,005,540 A | * | 4/1991 | Watanabe | 123/90.12 |
| 5,193,494 A | * | 3/1993 | Sono et al. | 123/90.12 |
| 5,499,606 A | * | 3/1996 | Robnett et al. | 123/90.12 |
| 5,577,468 A | * | 11/1996 | Weber | 123/90.12 |
| 6,192,841 B1 | * | 2/2001 | Vorih et al. | 123/90.12 |

FOREIGN PATENT DOCUMENTS

| | | |
|---|---|---|
| EP | 0 446 065 A | 9/1991 |
| FR | 2 468 733 A | 5/1981 |

* cited by examiner

*Primary Examiner*—Weilun Lo

(57) ABSTRACT

In an internal-combustion engine with a hydraulic system for variable operation of the valves, the tappet actuated by each cam of the camshaft is slidably mounted in a tubular body which is made of a single piece with a bushing for guiding the valve-actuating piston.

3 Claims, 3 Drawing Sheets

INTERNAL-COMBUSTION ENGINE WITH HYDRAULIC SYSTEM FOR VARIABLE OPERATION OF THE ENGINE VALVES

BACKGROUND OF THE INVENTION

The present invention relates to internal-combustion engines of the type comprising:

at least one induction valve and at least one exhaust valve for each cylinder, each valve being provided with respective elastic means that bring back the valve into the closed position to control communication between the respective induction and exhaust ducts and the combustion chamber;

a camshaft for operating the induction and exhaust valves of the cylinders of the engine by means of respective tappets, each induction valve and each exhaust valve being actuated by a cam of said camshaft;

in which at least one of said tappets controls the respective induction or exhaust valve against the action of said elastic return means via the interposition of hydraulic means including a hydraulic chamber containing fluid under pressure;

said hydraulic chamber containing fluid under pressure being connectable, via a solenoid valve, to an outlet channel for decoupling the valve from the respective tappet and causing fast closing of the valve under the action of respective elastic return means;

said hydraulic means further comprising a piston associated to the stem of the valve and slidably mounted in a guide bushing, said piston being set facing a variable-volume chamber defined by the piston inside the guide bushing, said variable-volume chamber being in communication with the hydraulic chamber containing fluid under pressure by means of an end aperture of said guide bushing, said piston having an end appendage designed to be inserted into said end aperture during the final stretch of the closing stroke of the valve in order to restrict the communication port between said variable-volume chamber and said hydraulic chamber containing fluid under pressure, so as to slow down the stroke of the valve in the proximity of its closing.

An engine of the type referred to above is, for example, described and illustrated in the European patent applications Nos. EP-A-0 803 642 and EP-A-1 091 097 filed by the present applicant.

SUMMARY OF THE INVENTION

The purpose of the present invention is to further improve the solutions previously proposed by the present applicant in order to render operation of the system for variable actuation of the engine valves as efficient and reliable as possible.

With a view to achieving this purpose, the subject of the invention is an internal-combustion engine having all the characteristics referred to above and further characterized in that the aforesaid piston for actuating the valve stem has its axis aligned with the axis of the respective tappet, and in that said tappet is slidably mounted in a tubular element which constitutes an integral prolongation of the guide bushing of the piston for actuating the valve stem.

Thanks to the above characteristic, the reliability of the system is improved with particular regard to the fact that the tubular element within which the tappet is slidably mounted may be stably secured in its mounting position (for example, by means of a fixing pin) in any operating condition of the engine, in contrast to what can occur in known solutions, where the tubular element within which the tappet is slidably mounted is a separate bushing screwed into a respective seat in the cylinder head of the engine, and is consequently subject to the risk of getting unscrewed.

According to a further characteristic, the tubular body, which is made of a single piece and defines both the guide bushing of the piston for actuating the stem and the tubular element for guiding the tappet, also defines within it the aforesaid pressure chamber and has at least one radial aperture for setting the said chamber in communication with a pipe for feeding oil under pressure. According to a further characteristic, reference means are provided for the correct angular position of the aforesaid tubular body in order to guarantee that the aforesaid radial aperture providing communication is aligned with the oil-feed pipe. This solution is more advantageous than the known solution, which did not envisage reference means for the angular mounting position, the tubular body being surrounded by a circumferential liner for communication with the oil feed so as to ensure setting-up of the communication for any angular mounting position.

As compared to the aforesaid known solution, the invention presents the advantage of enabling a substantial reduction of the space occupied by the oil under pressure, which makes it possible to bestow less elasticity on the system, with the consequent possibility of achieving higher engine r.p.m., this latter characteristic being particularly important, for example, in the case of an engine for a sports car.

BRIEF DESCRIPTION OF THE DRAWINGS

Further characteristics and advantages of the present invention will emerge from the ensuing description, with reference to the attached drawings, which are provided purely by way of non-limiting examples, and in which.

DETAILED DESCRIPTION OF THE INVENTION

Figure 1:
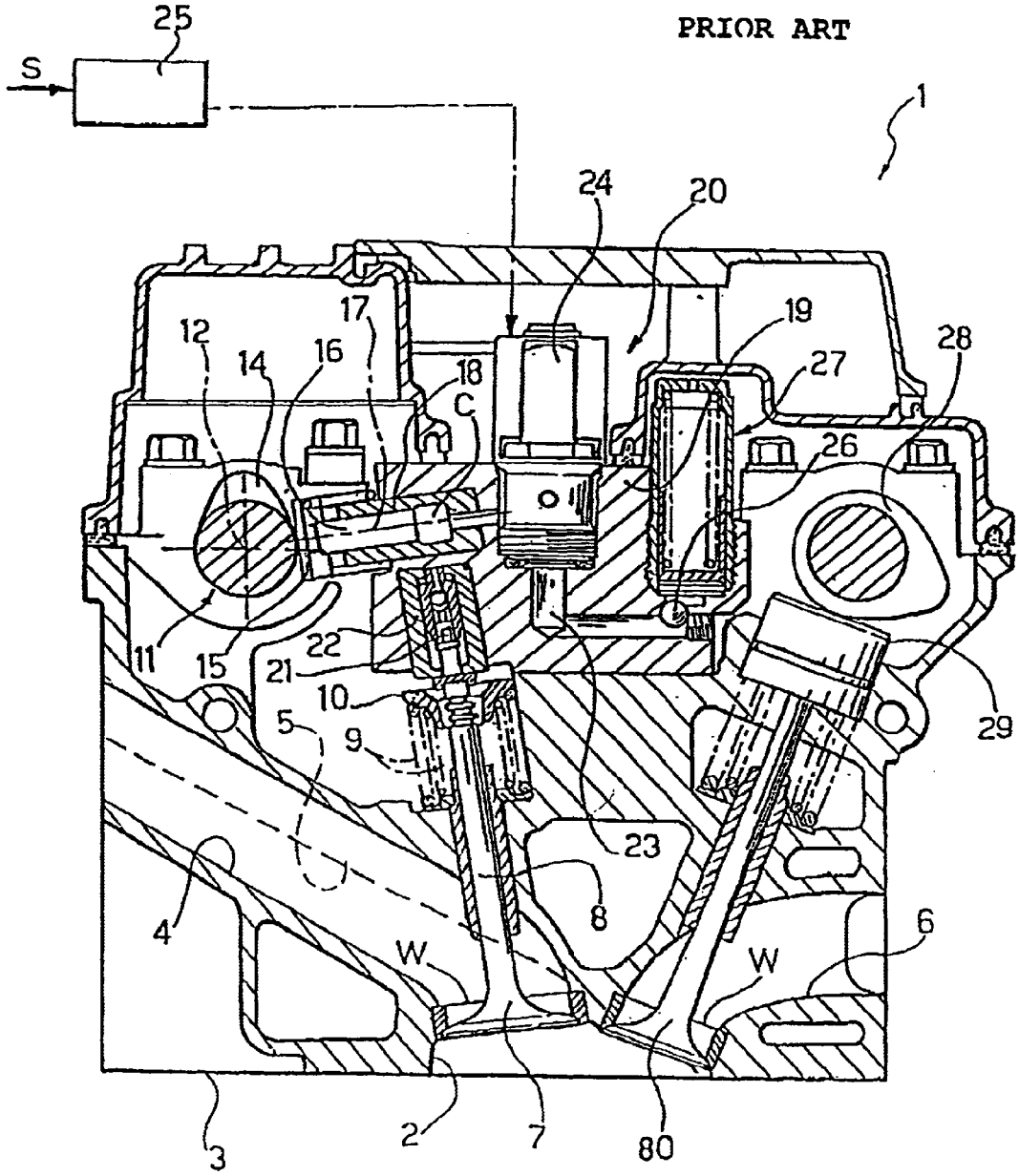
FIG. 1 PRIOR ART
FIG. 1 is a cross-sectional view of the cylinder head of an internal-combustion engine according to the embodiment known from the European patent application EP-A-0 803 642 filed by the present applicant.

With reference to FIG. 1, the internal-combustion engine described in the prior European patent application No. EP-A-0 803 642, as well as in EP-A1 091 097, filed by the present applicant is a multi-cylinder engine, for example, an engine with five cylinders set in line, comprising a cylindrical head 1.

The head 1 comprises, for each cylinder, a cavity 2 formed in the base surface 3 of the head 1, the said cavity 2 defining the combustion chamber into which two induction ducts 4, 5 and two exhaust ducts 6 give out. Communication of the two induction ducts 4, 5 with the combustion chamber 2 is controlled by two induction valves 7 of the traditional poppet or mushroom type, each comprising a stem 8 slidably mounted in the body of the head 1. Each valve 7 is brought back to the closing position by springs 9 set between an inner surface of the head 1 and an end cup 10 of the valve. Opening of the induction valves 7 is controlled, in the way that will be described in what follows, by a camshaft 11 which is slidably mounted about an axis 12 within supports of the head 1 and which comprises a plurality of cams 14 for operating the valves.

Each cam 14 for operating an induction valve 7 co-operates with the cap 15 of a tappet 16 slidably mounted along an axis 17, which in the case illustrated is directed substantially at 90° with respect to the axis of the valve 7 (the tappet may also be mounted so that it is aligned, as will be illustrated with reference to FIG. 3), within a bushing 18 carried by a body 19 of a pre-assembled subassembly 20 that incorporates all the electrical and hydraulic devices associated to operation of the induction valves, according to what is illustrated in detail in what follows. The tappet 16 is able to transmit a thrust to the stem 8 of the valve 7 so as to cause opening of the latter against the action of the elastic means 9 via fluid under pressure (typically oil coming from the engine-lubrication circuit) present in a chamber C and a piston 21 slidably mounted in a cylindrical body constituted by a bushing 22, which is also carried by the body 19 of the subassembly 20. Again according to the known solution illustrated in FIG. 1, the chamber C containing fluid under pressure associated to each induction valve 7 can be set in communication with an outlet channel 23 via a solenoid valve 24. The solenoid valve 24, which may be of any known type suitable for the function illustrated herein, is controlled by electronic control means, designated as a whole by 25, according to the signals S indicating operating parameters of the engine, such as the position of the accelerator and the engine r.p.m. When the solenoid valve 24 is opened, the chamber C enters into communication with the channel 23, so that the fluid under pressure present in the chamber C flows into said channel, and a decoupling of the tappet 16 of the respective induction valve 7 is obtained, the said induction valve 7 then returning rapidly into its closed position under the action of the return spring 9. By controlling the communication between the chamber C and the outlet channel 23, it is therefore possible to vary the opening time and opening stroke of each induction valve 7 as desired.

The outlet channels 23 of the various solenoid valves 24 all open out into one and the same longitudinal channel 26, which communicates with one or more pressure accumulators 27, only one of which can be seen in FIG. 1. All the tappets 16 with the associated bushings 18, the pistons 21 with the associated bushings 22, and the solenoid valves 24 and the corresponding channels 23, 26 are carried and made in the aforesaid body 19 of the pre-assembled subassembly 20, to the advantage of speed and ease of assembly of the engine.

The exhaust valves 80 associated to each cylinder are controlled, in the embodiment illustrated in FIG. 1, in a traditional way by a camshaft 28 by means of respective tappets 29.

Figure 2:
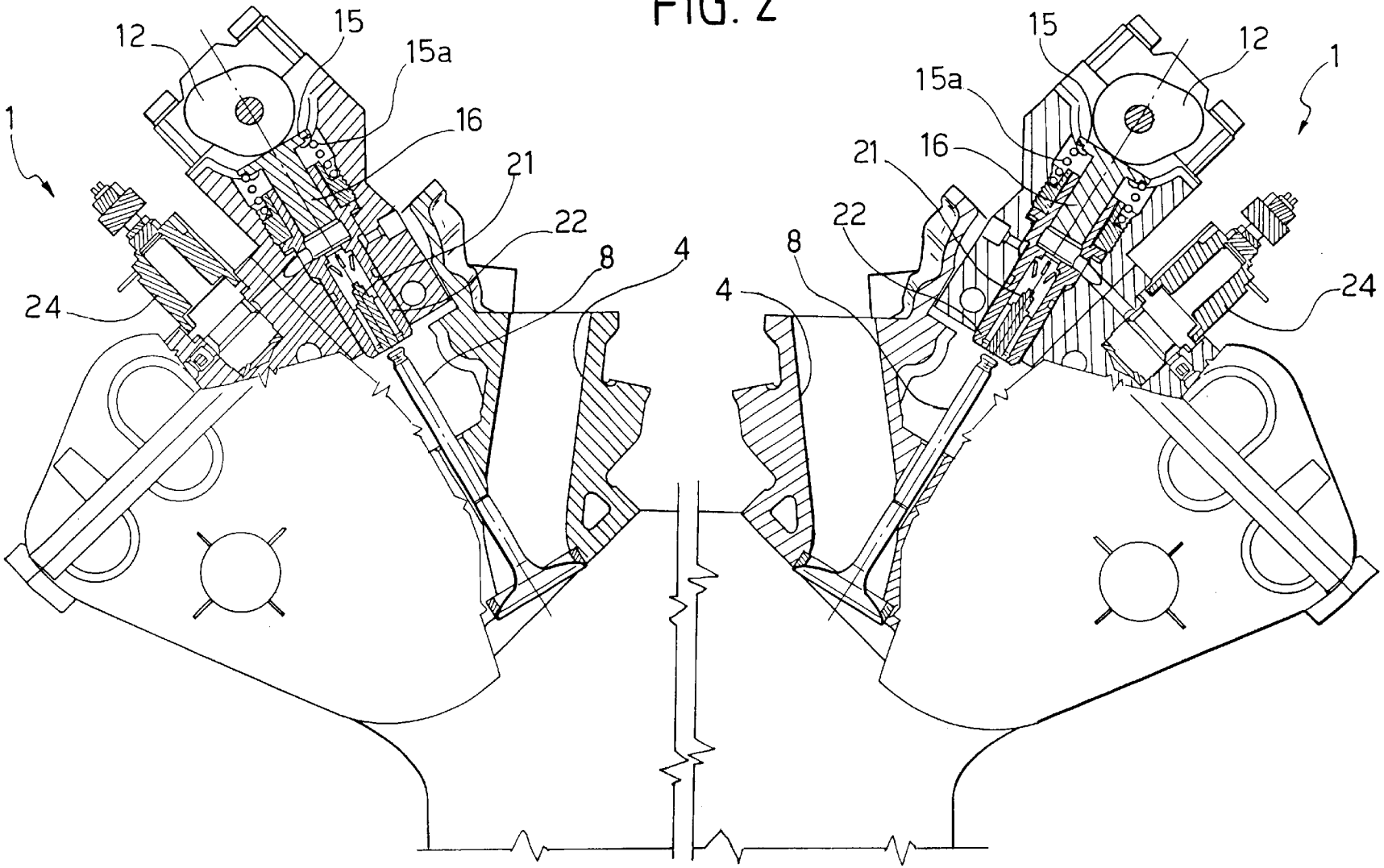
FIG. 2 is a cross-sectional view of the cylinder heads of an eight-cylinder V engine with four cylinders per bank, made in accordance with the present invention.

FIG. 2 illustrates, at an enlarged scale, the body 19 of the pre-assembled subassembly.

FIG. 2 illustrates a simplified version of a variable-control valve applied to an example of embodiment of an engine according to the invention, in which the axis of the tappet 16 is aligned with the axis of the piston 21 for actuating the valve. The illustrated example of the invention refers to the case of an eight-cylinder V engine with four cylinders per bank. In FIG. 2, the parts in common with FIG. 1 are designated by the same reference numbers. Rotation of the cam (not illustrated in FIG. 2) causes a thrust on the cap 15 with a consequent lowering of the tappet 16 against the action of the spring 15*a*. The oil under pressure present in the chamber C consequently causes movement of the piston 21 that actuates the stem of the valve. The chamber C can be emptied of oil under pressure by means of the solenoid valve 24.

Figure 3:
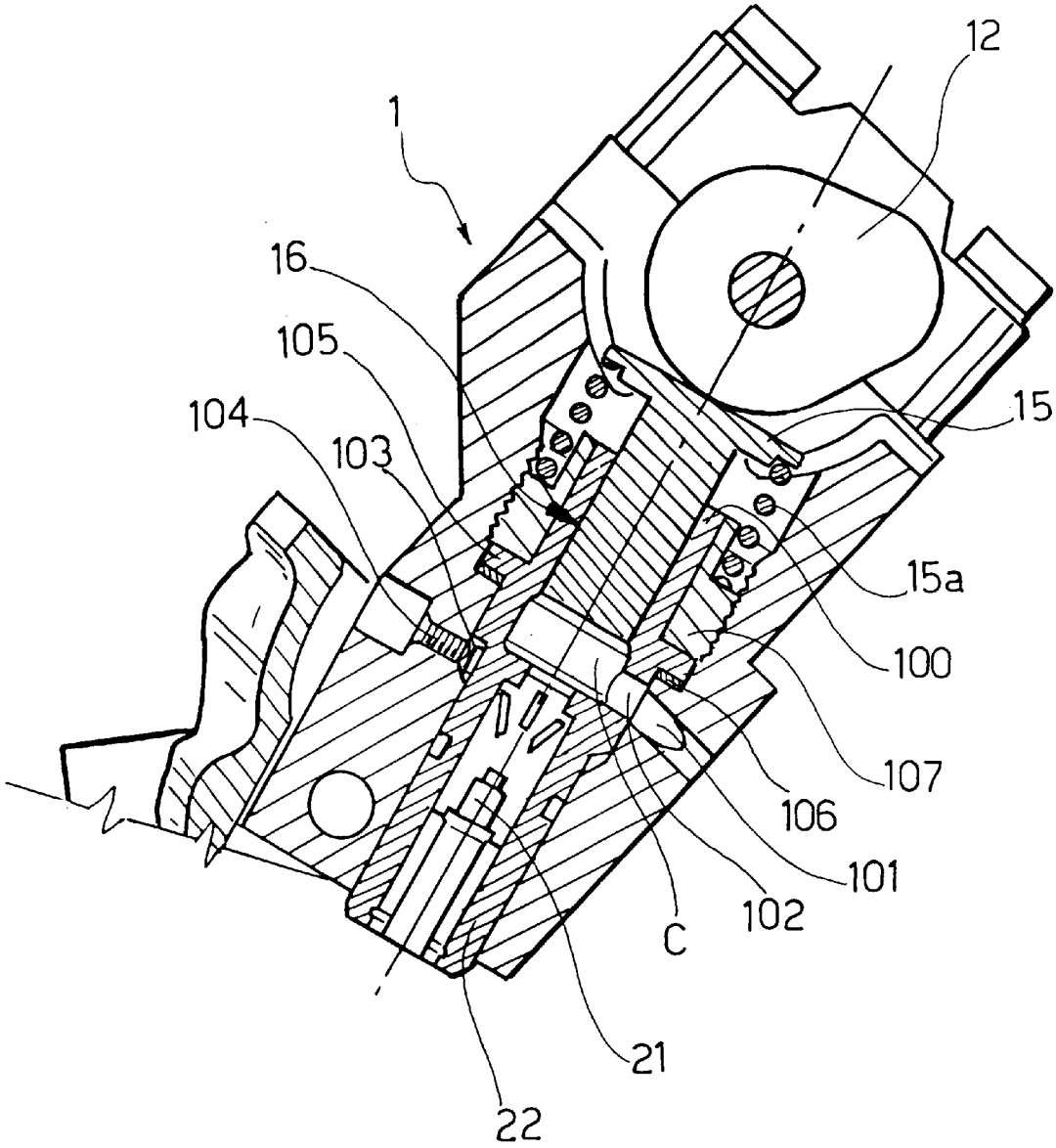
FIG. 3 is a view at an enlarged scale of a detail of FIG. 2.

As may be clearly seen in FIG. 3, in the example of embodiment illustrated therein the bushing 22 for guiding the piston 21 for actuating the valve stem is prolonged in a single piece with a tubular portion 100 serving as a guide for the tappet 16.

As may be seen in FIG. 3, moreover, the single tubular body which defines the bushing 22 for guiding the piston 21 and the tubular portion 100 for guiding the tappet 16, also defines, within it, the high-pressure chamber C which communicates with a pipe 101 for feeding oil under pressure through a radial hole 102 made in the tubular body.

In order to guarantee that the tubular body 22/100 is mounted in the correct angular position, with the radial hole 21 facing the pipe 101, the tubular body has an external groove 103 which is engaged by a threaded grub screw 104 screwed into the body of the cylinder head.

The tubular body 22/100 is provided with an annular flange 105, which is pressed against an annular contrast surface of the cylinder head, with interposition of a washer 106. The flange 105 is held in position by a ring nut 107 which is screwed into a threaded cylindrical cavity made in the cylinder head.

The example of embodiment illustrated refers to the case of engine induction valves. It is evident, however, that the invention may be applied both to induction valves and to exhaust valves.

What is claimed is:

1. An internal-combustion engine comprising:

at least one induction valve and at least one exhaust valve for each cylinder, each valve being provided with respective elastic means that bring back the valve into the closed position to control communication between the respective induction and exhaust ducts and the combustion chamber;

a camshaft for operating the induction and exhaust valves of the cylinders of the engine by means of respective tappets, each induction valve and each exhaust valve being actuated by a cam of said camshaft;

wherein at least one of said tappets control a respective valve against the action of said elastic return means by interposition of hydraulic means including a hydraulic chamber containing fluid under pressure;

said hydraulic chamber containing fluid under pressure being connectable, to an outlet channel for decoupling the valve from the respective tappet and causing fast closing of the valve under the action of respective elastic return means;

a solenoid valve operatively associated with said outlet channel to open and close said outlet channel;

said hydraulic means further comprising a piston associated to the stem of the valve and slidably mounted in a guide bushing, said piston being set facing a variable-volume chamber defined by the piston inside the guide bushing, said variable-volume chamber being in communication with the hydraulic chamber containing fluid under pressure by means of an end aperture of said guide bushing, said piston having an end appendage designed to be inserted into said end of the valve in order to restrict the communication port between said variable-volume chamber and said hydraulic chamber containing fluid under pressure, so as to slow down the stroke of the valve in the proximity of its closing, wherein the aforesaid piston for actuating the valve stem has its axis aligned with the axis of the respective tappet, and wherein said tappet is slidably mounted in a tubular element which constitutes an integral prolongation of the guide bushing for guiding the piston for actuating the valve stem.

2. The engine according to claim 1, wherein the tubular body which is made of a single piece and defines both the guide bushing of the piston for actuating the valve stem and the tubular element for guiding the tappet, also defines within it the hydraulic chamber (C) and has at least one radial aperture for setting the hydraulic chamber (C) in communication with an oil feed pipe for feeding oil under pressure.

3. The engine according to claim 2, wherein reference means, are provided for the correct angular position of the tubular body in order to guarantee that the radial aperture is aligned with the oil-feed pipe.

* * * * *